US010823407B2

(12) United States Patent
Mullin et al.

(10) Patent No.: US 10,823,407 B2
(45) Date of Patent: Nov. 3, 2020

(54) MOTOR CONTROLLER FOR BLOWER IN GAS-BURNING APPLIANCE AND METHOD OF USE

(71) Applicant: Regal Beloit America, Inc., Beloit, WI (US)

(72) Inventors: Paul Steven Mullin, Yellow Springs, OH (US); William Stuart Gatley, Cassville, MO (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 144 days.

(21) Appl. No.: 15/278,877

(22) Filed: Sep. 28, 2016

(65) Prior Publication Data

US 2018/0087775 A1 Mar. 29, 2018

(51) Int. Cl.
*F23N 3/08* (2006.01)
*F23N 1/08* (2006.01)

(52) U.S. Cl.
CPC ..... *F23N 3/085* (2013.01); *F23N 1/082* (2013.01); *F23N 2225/06* (2020.01); *F23N 2233/04* (2020.01)

(58) Field of Classification Search
CPC ... F23N 3/085; F23N 2033/04; F23N 2025/06
See application file for complete search history.

(56) References Cited

U.S. PATENT DOCUMENTS 3,200,274 A 8/1965 Munier
3,241,017 A 3/1966 Madsen et al.
3,990,014 A 11/1976 Hakozaki
4,506,201 A 3/1985 Tsuneki
4,510,266 A 4/1985 Eertink
4,677,357 A * 6/1987 Spence ..... F23N 5/184 110/189
5,076,761 A 12/1991 Krohn et al.
5,297,047 A * 3/1994 Matsuno ..... F02D 41/221 701/107
5,539,601 A 7/1996 Farag
5,539,672 A 7/1996 Mullin et al.
(Continued)

FOREIGN PATENT DOCUMENTS

EP 1211787 B1 6/2002
EP 1372250 B1 12/2003
WO 2005046042 A1 5/2005

OTHER PUBLICATIONS

Wikipedia. PID Controller. Oct. 19, 2015. <https://en.wikipedia.org/wiki/PID_controller> (Year: 2015).*
ISR/WO PCT/US2015046164 dated Nov. 12, 2015, 11 pages.

*Primary Examiner* — Grant Moubry
*Assistant Examiner* — Rabeeul I Zuberi
(74) *Attorney, Agent, or Firm* — Armstrong Teasdale LLP

(57) ABSTRACT

A motor controller for a blower in a gas-burning appliance. The motor controller includes a processor configured to receive a measured pressure differential measured by a sensor disposed in an airflow generated by the blower. The processor is configured to compute a motor speed based on the measured pressure differential and a pressure differential set-point for the gas-burning appliance. The processor is configured to operate the blower at the motor speed to drive the measured pressure differential toward the pressure differential set-point.

16 Claims, 6 Drawing Sheets

(56) References Cited

U.S. PATENT DOCUMENTS

| | | | | |
|---|---|---|---|---|
| 5,648,892 | A | 7/1997 | Wieloch et al. | |
| 5,907,475 | A | 5/1999 | Babinski et al. | |
| 6,055,141 | A | 4/2000 | Dorschky et al. | |
| 6,318,358 | B1 * | 11/2001 | Gatley, Jr. | F04D 25/082 126/110 R |
| 6,380,757 | B1 | 4/2002 | Draves et al. | |
| 6,462,494 | B1 * | 10/2002 | Schone | F04D 27/004 318/433 |
| 6,639,502 | B2 | 10/2003 | Herrick | |
| 6,850,822 | B2 | 2/2005 | Parsadayan et al. | |
| 6,936,989 | B2 | 8/2005 | Hogan | |
| 8,853,984 | B2 | 10/2014 | Yeh | |
| 9,188,508 | B1 * | 11/2015 | Meyer | G01M 99/005 |
| 2001/0051321 | A1 * | 12/2001 | La Fontaine | F23N 1/022 431/12 |
| 2003/0059730 | A1 * | 3/2003 | Sigafus | F23N 1/002 431/18 |
| 2006/0117769 | A1 * | 6/2006 | Helt | F24F 11/0001 62/161 |
| 2006/0266348 | A1 * | 11/2006 | Jauch, Jr. | F24H 3/0488 126/110 C |
| 2007/0012181 | A1 * | 1/2007 | Niezgoda | B01D 46/0038 95/1 |
| 2008/0297011 | A1 | 12/2008 | Delaney et al. | |
| 2009/0211540 | A1 * | 8/2009 | Yin | F24H 1/205 122/18.3 |
| 2009/0324205 | A1 | 12/2009 | Lambrechts et al. | |
| 2013/0307661 | A1 | 11/2013 | Winheim | |
| 2014/0127632 | A1 | 5/2014 | Garrison et al. | |

* cited by examiner

MOTOR CONTROLLER FOR BLOWER IN GAS-BURNING APPLIANCE AND METHOD OF USE

BACKGROUND

The field of the disclosure relates generally to airflow in gas-burning appliances, and more specifically to a motor controller for a blower in gas-burning appliances.

Known gas-burning appliances require sufficient airflow to exhaust, and to reduce the concentration of, dangerous combustion gas by-products, such as, for example, $NO_3$ and $NO_4$, among others, otherwise referred to as $NO_x$. In some known high efficiency furnaces, water heaters, and other gas-burning appliances, standard chimney air-draw effects are not sufficient to assure the required airflow through the gas burners and heat exchangers, and therefore, some known gas-burning appliances utilize draft inducers to provide sufficient airflow through the heat exchangers of the furnace and to reduce the concentration of combustion by-products. The generated airflow is typically drawn in from the ambient or through an inlet duct by a blower, and typically exhausted through an exhaust duct. Inlet ducts and exhaust ducts generally pose a restriction on the generated airflow, as do the gas burner, heat exchanger, and the blower itself. Blowers installed in gas-burning appliances are typically selected to operate at a sufficient speed and volume to generate the necessary airflow for efficient heat transfer within the appliance and to exhaust combustion gases with an acceptable by-product concentration.

Inlet ducts and exhaust ducts for gas-burning appliances generally vary in length per installation. Many known gas-burning appliances utilize a blower that generates a sufficient airflow for the longest, most restricted, ducts for a particular gas-burning appliance. Many known gas-burning appliances specify a maximum restriction or duct length to ensure sufficient airflow. For example, a water heater may specify that inlet and exhaust ducts may not exceed 150 feet in length. Many installations of such gas-burning appliances utilize inlet ducts and exhaust ducts that are below the specified maximum length and, consequently, utilize blowers that far exceed the necessary airflow for the gas-burning appliance. In such installations, the blower generates excessive airflow that, although sufficiently exhausts combustion gases, reduces the efficiency of combustion and heat exchange within the gas-burning appliance.

BRIEF DESCRIPTION

In one aspect, a motor controller for a blower in a gas-burning appliance is provided. The motor controller includes a processor configured to receive a measured pressure differential measured by a sensor disposed in an airflow generated by the blower. The processor is configured to compute a motor speed based on the measured pressure differential and a pressure differential set-point for the gas-burning appliance. The processor is configured to operate the blower at the motor speed to drive the measured pressure differential toward the pressure differential set-point.

In another aspect, an exhaust system for gas-burning appliance is provided. The exhaust system includes a blower, a motor, a pressure sensor, and a motor controller. The blower is configured to generate an airflow through a duct comprising a gas burner, a non-variable airflow restriction, and an exhaust duct. The motor is coupled to the blower and is configured to operate the blower at a variable motor speed. The pressure sensor is disposed in the airflow and is configured to measure a pressure differential across the non-variable airflow restriction by the airflow. The motor controller is coupled to the motor and the pressure sensor. The motor controller is configured to compute a motor speed based on the pressure differential and a pressure differential set-point. The motor controller is further configured to operate the blower at the motor speed to converge the pressure differential onto the pressure differential set-point.

In yet another aspect, a method of controlling a blower in a gas-burning appliance is provided. The method includes operating a blower at a first motor speed to generate an airflow through a duct comprising a gas burner, a non-variable airflow restriction, and an exhaust duct. The method includes measuring a pressure differential across the non-variable airflow restriction. The method includes comparing the pressure differential to a pressure differential set-point. The method includes computing a second motor speed based on the comparing. The method includes operating the blower at the second motor speed to modify the airflow.

DETAILED DESCRIPTION

As used herein, an element or step recited in the singular and preceded with the word "a" or "an" should be understood as not excluding plural elements or steps, unless such exclusion is explicitly recited. Furthermore, references to "example implementation" or "one implementation" of the present disclosure are not intended to be interpreted as excluding the existence of additional implementations that also incorporate the recited features.

Gas-burning appliances, such as, for example, and without limitation, furnaces and water heaters, burn a mixture of air and a fuel to generate heat that is carried by combustion gasses. The combustion gasses are typically drawn through a heat exchanger by a blower, and then vented out through an exhaust duct. While flowing through the heat exchanger, the combustion gasses heat another medium, such as, for example, water. If the airflow is too little, combustion gasses are not properly evacuated from the gas-burning appliance and can potentially leak into the ambient air, creating a hazardous condition. If the airflow is too great, combustion gasses are properly vented, but the combustion and heat exchange become less efficient. The airflow necessary to properly vent the combustion gasses generally depends on the length of the inlet ducts, if any, and the exhaust duct. Longer ducts require greater airflow to vent combustion gasses. Blowers in gas-burning appliances are typically configured to operate at a fixed speed that is sufficient, i.e., high enough, to exhaust combustion gasses for the longest possible duct for the gas-burning appliance. Motor controllers described herein regulate motor speed for the blower based on measured pressure differentials within the duct to achieve both sufficient ventilation of combustion gasses and high-efficiency combustion and heat exchange.

Embodiments of the present disclosure provide a motor controller for a blower in gas-burning appliances. More specifically, embodiments of the motor controller described herein operate a blower to sufficiently exhaust combustion gasses and to achieve high-efficiency combustion and heat exchange. Embodiments of the motor controller described herein utilize pressure differential measurements across a non-variable airflow restriction within the gas-burning appliance to adjust a variable motor speed at which the blower is operated. Measured pressure differential is compared to a pressure differential set-point to adjust motor speed using a proportional-integral (PI) control loop. Motor controllers described herein achieve sufficient exhaust and high-efficiency combustion and heat exchange regardless of inlet duct length and further regardless of exhaust duct length.

Figure 1:
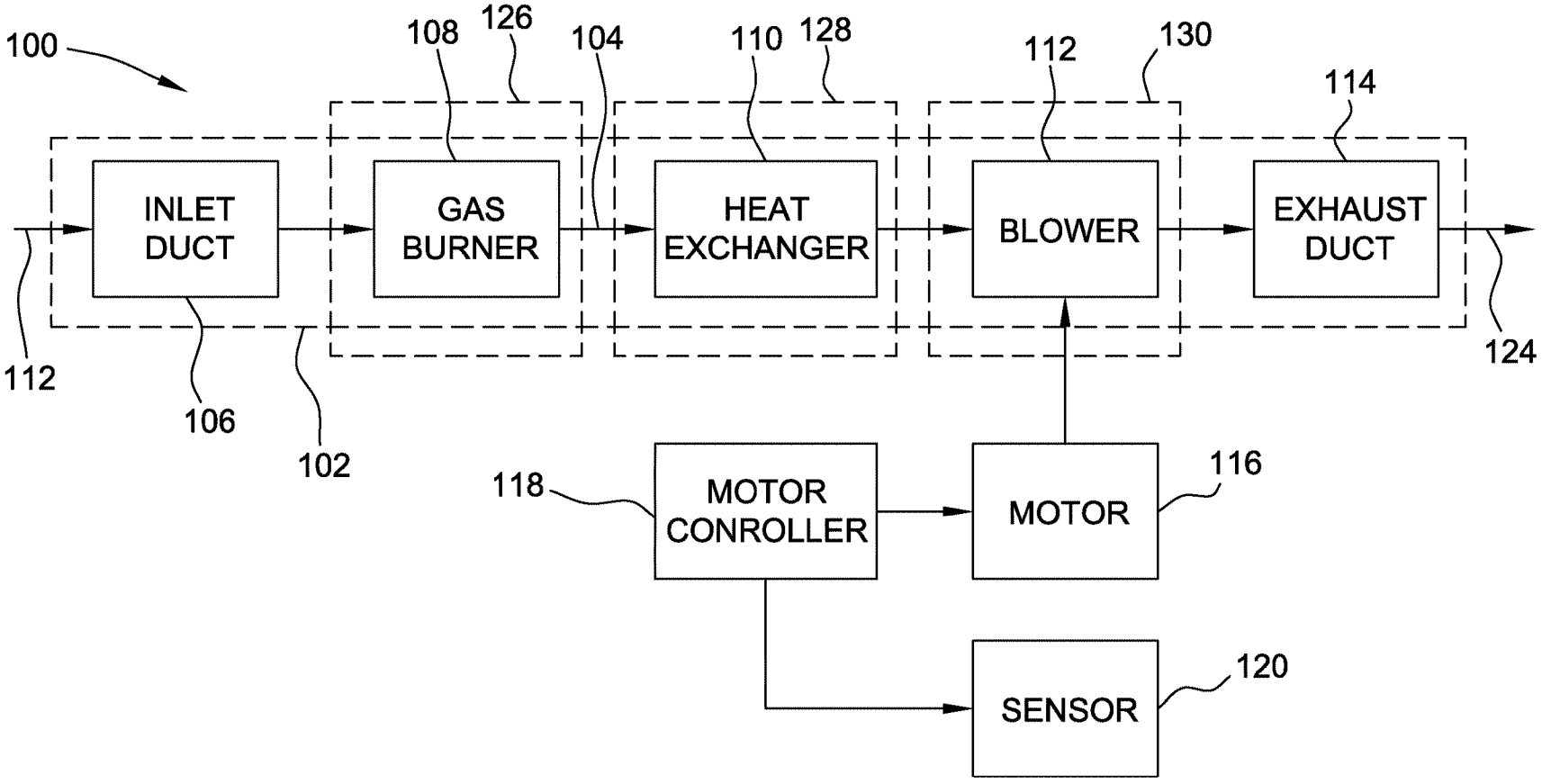
FIG. 1 is a block diagram of an exemplary gas-burning appliance.

FIG. 1 is a block diagram of an exemplary gas-burning appliance 100. Gas-burning appliance 100 includes a duct 102 through which an airflow 104 passes. Duct 102 includes an inlet duct 106, a gas burner 108, a heat exchanger 110, a blower 112, and an exhaust duct 114. Airflow 104 begins with an inlet airflow 122 at inlet duct 106. Airflow 104 exits gas-burning appliance 100 at exhaust duct 114 with an exhaust airflow 124. Each component of duct 102 poses a restriction on airflow 104. For example, an airflow restriction created by inlet duct 106 or exhaust duct 114 depends on the respective lengths of inlet duct 106 and exhaust duct 114. Similarly, dramatic changes in direction of airflow 104, such as, for example, elbows and bends in inlet duct 106 and exhaust duct 114, introduce airflow restrictions. Certain portions of duct 102 are referred to as non-variable airflow restrictions, because the degree to which airflow 104 is restricted does not change from installation to installation. For example, the degree to which gas burner 108 and heat exchanger 110 restrict airflow 104 does not change from installation to installation. Likewise, the degree to which blower 112 restricts airflow 104 does not change from installation to installation. Gas burner 108, heat exchanger 110, and blower 112 are also respectively referred to as non-variable airflow restrictions 126, 128, and 130. Conversely, the degree to which inlet duct 106 and exhaust duct 114 restrict airflow 104 changes from installation to installation as a function of the respective length of duct installed and how circuitous the installed duct is. Although blower 112 is shown as positioned proximate exhaust duct 114, it is contemplated that blower 112 may be located at any position along duct 102. For example, blower 112 may be located upstream of burner 108 such that blower 112 pushes air through burner 108 rather than pulling air through burner 108, as is shown in FIG. 1.

Gas-burning appliance 100 further includes a motor 116 for turning blower 112. Gas-burning appliance 100 further includes a motor controller 118 and a sensor 120. Motor controller 118 controls motor 116 by transmitting a control signal representing a variable motor speed. The control signal may be implemented, for example, and without limitation, as a square wave. In certain embodiments, the control signal may undergo pulse width modulation to affect a change in duty cycle that represents a motor speed set-point. Sensor 120 may include, for example, and without limitation, a pressure sensor that approximates airflow 104 by measuring a pressure differential across a portion of duct 102.

Figure 2:
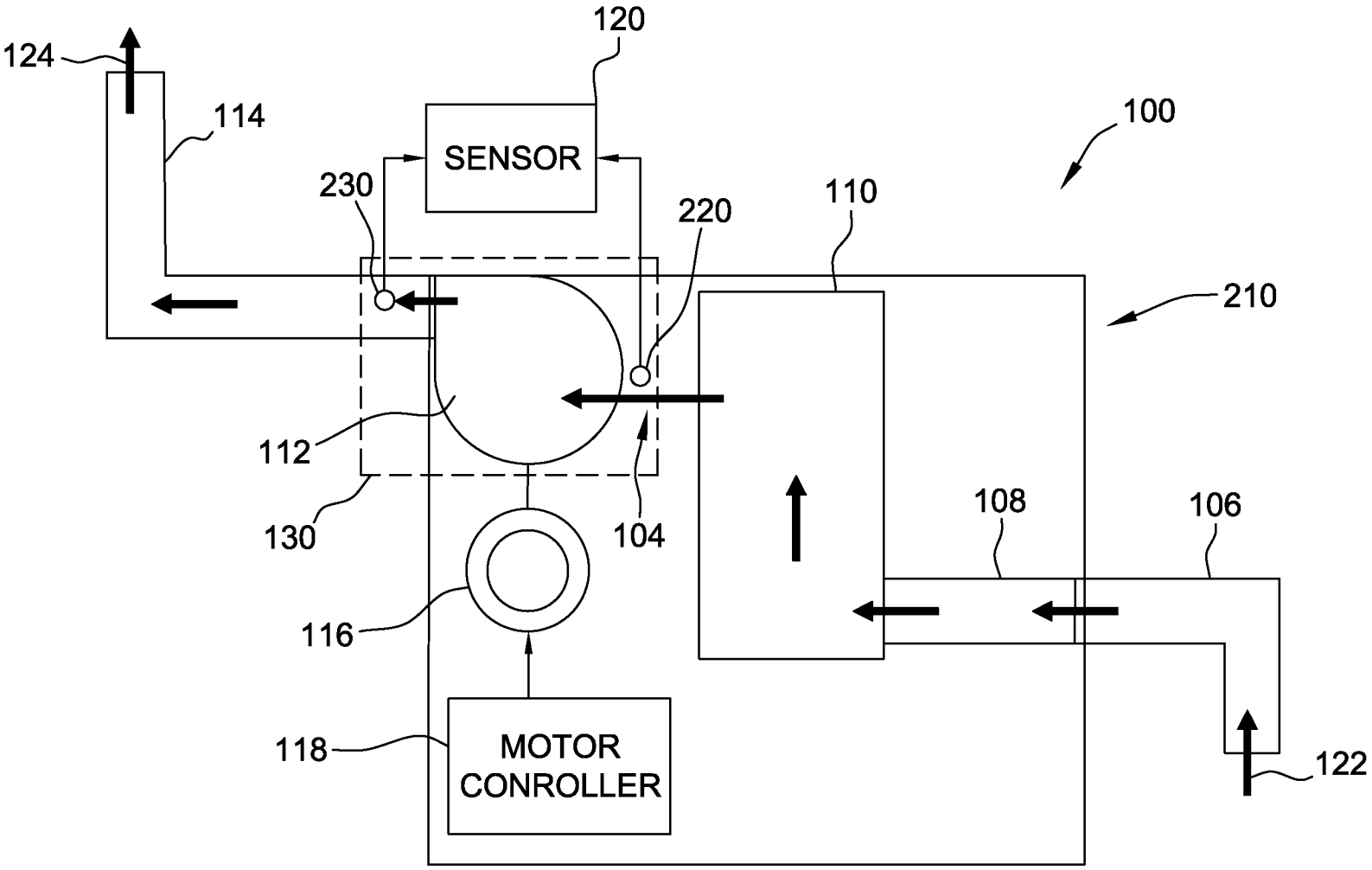
FIG. 2 is a schematic diagram of one embodiment of the gas-burning appliance shown in FIG. 1.

FIG. 2 is a schematic diagram of one embodiment of gas-burning appliance 100 (shown in FIG. 1). Gas-burning appliance 100 includes an enclosure 210 within which certain components of gas-burning appliance 100 are disposed. Gas burner 108, heat exchanger 110, blower 112, motor 116, and motor controller 118 are located within enclosure 210. In alternative embodiments, one or more of gas burner 108, heat exchanger 110, blower 112, motor 116, and motor controller 118 may be located outside enclosure 210. Similarly, sensor 120 is illustrated, in FIG. 2, as located outside enclosure 210. In alternative embodiments, sensor 120 may be located within enclosure 210. Furthermore, although blower 112 is shown as positioned proximate exhaust duct 114, it is contemplated that blower 112 may be located at any position along duct 102. For example, blower 112 may be located upstream of burner 108, either within or outside of enclosure 210, such that blower 112 pushes air through burner 108 rather than pulling air through burner 108, as is shown in FIG. 2.

Airflow 104 enters gas-burning appliance 100 at inlet duct 106, which is illustrated by inlet airflow 122. Airflow 104 is generated by the turning of blower 112 by motor 116 to draw-in inlet airflow 122. Inlet duct 106 has a length and, in certain embodiments, one or more turns in its path to burner 108. The length and turns of inlet duct 106 at least partially define the airflow restriction it poses to airflow 104. Burner 108 carries out combustion of inlet airflow 122 and a fuel, producing combustion gasses that may include $NO_x$ gasses. Combustion gasses pass through heat exchanger 110, where heat is transferred from the combustion gasses to another medium, such as, for example, and without limitation, water. Airflow 104 carries the combustion gasses from heat exchanger 110, through blower 112, and through exhaust duct 114. Exhaust duct has a length and, in certain embodiments, one or more turns in its path. The length and turns of exhaust duct 114 at least partially define the airflow restriction it poses to airflow 104. Combustion gasses are vented from exhaust duct 114 as exhaust airflow 124.

Motor controller 118 controls motor 116, at least, by transmitting a control signal representing a variable motor speed. Motor controller 118 determines a motor speed set-point based on a pressure differential measured by sensor 120. Sensor 120 measures a pressure differential across a non-variable airflow restriction. A measured pressure differential across a non-variable airflow restriction generally does not change from installation to installation. Conversely, airflow 104 can change from installation to installation based on at least the respective lengths and paths of inlet duct 106 and exhaust duct 114. Changes in airflow 104 are reflected in the pressure differential measured by sensor 120, however, because sensor 120 measures the pressure differential across a non-variable airflow restriction, any changes in measured pressure differential are attributed to variables external to that non-variable airflow restriction, such as, for example, respective lengths and paths of inlet duct 106 and exhaust duct 114.

In the embodiment of FIG. 2, sensor 120 measures a pressure differential across blower 112, otherwise referred to as non-variable airflow restriction 130. Sensor 120 includes a first node 220 disposed within enclosure 210 and between heat exchanger 110 and an inlet of blower 112. Sensor 120 includes a second node 230 disposed at an outlet of blower 112, where airflow 104 enters exhaust duct 114. Sensor 120 measures the pressure differential over time and transmits the measurements to motor controller 118. The frequency at which sensor 120 measures the pressure differential varies per embodiment and per installation. In certain embodiments, for example, and without limitation, sensor 120 measures the pressure differential five times per second, or at a frequency of 5 Hertz. In alternative embodiments, sensor 120 may be configured to operate at any suitable frequency for producing stable control of motor 116. Motor controller 118 computes a rolling average of the measured pressure differential and compares the average pressure differential to a pressure differential set-point. The pressure differential set-point is predetermined for blower 112 to represent a desired airflow 104 to achieve sufficient ventilation of combustion gasses through exhaust duct 114, high-efficiency combustion in gas burner 108, and high-efficiency heat transfer in heat exchanger 110. Motor controller 118 adjusts the variable speed of motor 116 to compensate for differences in the measured pressure differential relative to the pressure differential set-point, which, as described above, are attributed to variables external to blower 112, such as, for example, the respective lengths and paths of inlet duct 106 and exhaust duct 114.

Motor controller 118 adjusts the variable speed of motor 116 by setting a motor speed set-point via a control signal. The control signal may include a pulse width modulated square wave having a duty cycle that represents the motor speed set-point. Motor controller 118 computes the motor speed set-point using a PI control loop. In alternative embodiments, motor controller 118 may utilize a proportional-integral-derivative (PID) control loop or any other suitable control scheme for computing the motor speed set-point. Within the PI control loop, the difference between the measured pressure differential across non-variable airflow restriction 130 and the pressure differential set-point is utilized as an error value upon which the proportional term and the integral term of the PI control loop operate. The output of the PI control loop is the motor speed set-point, i.e., the desired motor speed to turn blower 112 and to generate airflow 104. The PI control loop ensures the measured pressure differential converges on the pressure differential set-point and, more specifically, airflow 104 converges on the desired airflow 104 that is sufficient to achieve sufficient ventilation of combustion gasses through exhaust duct 114, high-efficiency combustion in gas burner 108, and high-efficiency heat transfer in heat exchanger 110.

Figure 3:
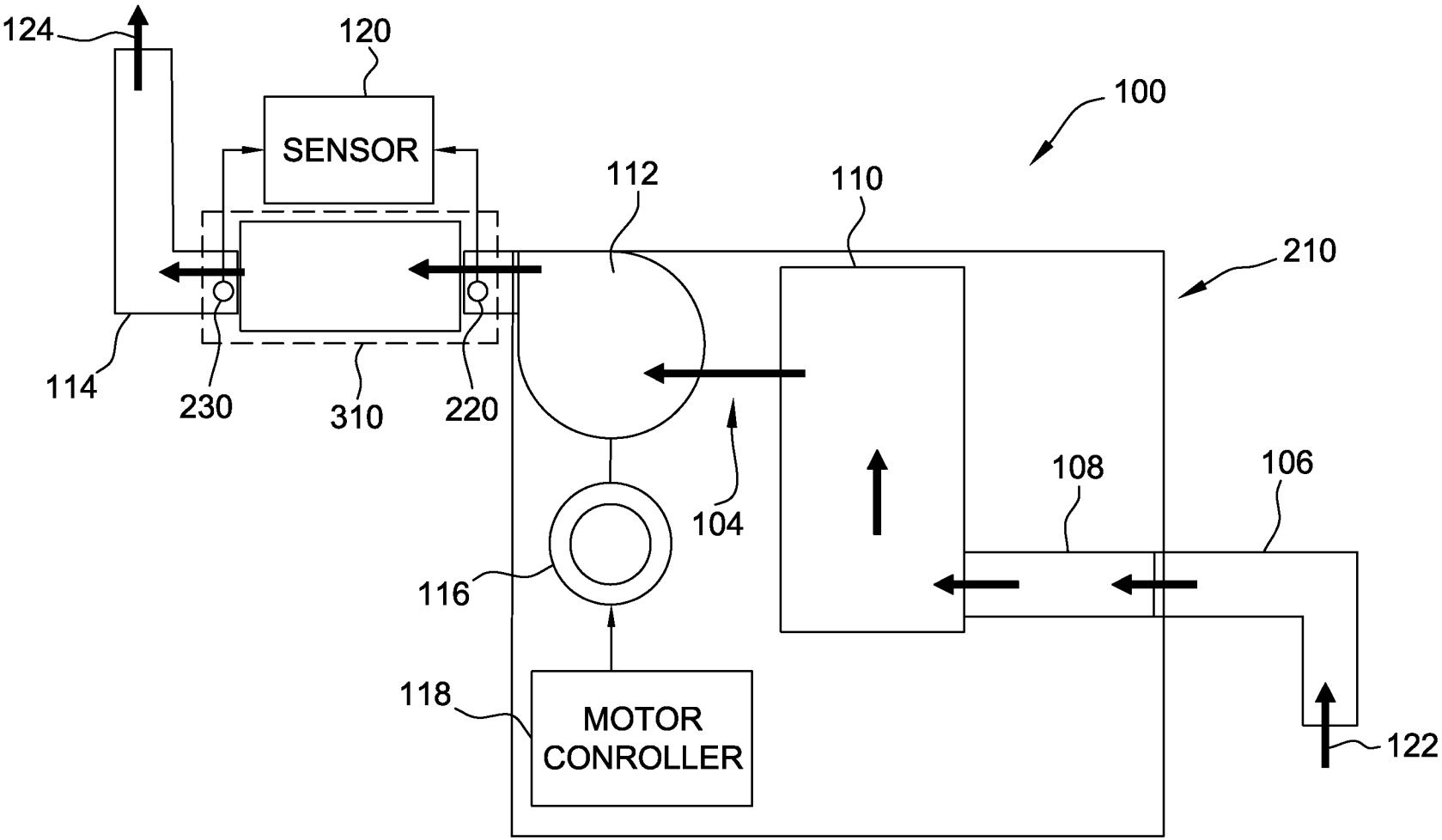
FIG. 3 is a schematic diagram of another embodiment of the gas-burning appliance shown in FIG. 1.

FIG. 3 is a schematic diagram of another embodiment of gas-burning appliance 100 (shown in FIG. 1). Gas-burning appliance 100 includes enclosure 210, gas burner 108, heat exchanger 110, blower 112, motor 116, and motor controller 118, and sensor 120.

Similar to the embodiment of FIG. 2, airflow 104 enters gas-burning appliance 100 at inlet duct 106, which is illustrated by inlet airflow 122. Airflow 104 is generated by the turning of blower 112 by motor 116 to draw-in inlet airflow 122. Inlet duct 106 has a length and, in certain embodiments, one or more turns in its path to burner 108. The length and turns of inlet duct 106 at least partially define the airflow restriction it poses to airflow 104. Burner 108 carries out combustion of inlet airflow 122 and a fuel, producing combustion gasses that may include $NO_x$ gasses. Combustion gasses pass through heat exchanger 110, where heat is transferred from the combustion gasses to another medium, such as, for example, and without limitation, water. Airflow 104 carries the combustion gasses from heat exchanger 110, through blower 112, and through a non-variable airflow restriction 310. Airflow then passes through exhaust duct 114. Exhaust duct has a length and, in certain embodiments, one or more turns in its path. The length and turns of exhaust duct 114 at least partially define the airflow restriction it poses to airflow 104. Combustion gasses are vented from exhaust duct 114 as exhaust airflow 124. Furthermore, although blower 112 is shown as positioned proximate exhaust duct 114, it is contemplated that blower 112 may be located at any position along duct 102. For example, blower 112 may be located upstream of burner 108, either within or outside of enclosure 210, such that blower 112 pushes air through burner 108 rather than pulling air through burner 108, as is shown in FIG. 3.

Motor controller 118 controls motor 116, at least, by transmitting a control signal representing a variable motor speed. Motor controller 118 determines a motor speed set-point based on a pressure differential measured by sensor 120. Sensor 120 measures a pressure differential across non-variable airflow restriction 310. The measured pressure differential across non-variable airflow restriction 310 generally does not change from installation to installation. Conversely, airflow 104 can change from installation to installation based on at least the respective lengths and paths of inlet duct 106 and exhaust duct 114. Changes in airflow 104 are reflected in the pressure differential measured by sensor 120, however, because sensor 120 measures the pressure differential across non-variable airflow restriction 310, any changes in measured pressure differential are attributed to variables external to non-variable airflow restriction 310, such as, for example, respective lengths and paths of inlet duct 106 and exhaust duct 114.

In the embodiment of FIG. 3, sensor 120 measures a pressure differential across non-variable airflow restriction 310. Sensor 120 includes first node 220 disposed at an outlet of blower 112, where airflow 104 enters non-variable airflow restriction 310. Sensor 120 includes second node 230 disposed at an inlet of exhaust duct 114, where airflow 104 moves from non-variable airflow restriction into exhaust duct 114. Sensor 120 measures the pressure differential over time and transmits the measurements to motor controller 118. The frequency at which sensor 120 measures the pressure differential varies per embodiment and per installation. In certain embodiments, for example, and without limitation, sensor 120 measures the pressure differential five times per second, or at a frequency of 5 Hertz. In alternative embodiments, sensor 120 may be configured to operate at any suitable frequency for producing stable control of motor 116. Motor controller 118 computes a rolling average of the measured pressure differential and compares the average pressure differential to a pressure differential set-point. The pressure differential set-point is predetermined for non-variable airflow restriction 310 to represent a desired airflow 104 to achieve sufficient ventilation of combustion gasses through exhaust duct 114, high-efficiency combustion in gas burner 108, and high-efficiency heat transfer in heat exchanger 110. Motor controller 118 adjusts the variable speed of motor 116 to compensate for differences in the measured pressure differential relative to the pressure differential set-point, which, as described above, are attributed to variables external to non-variable airflow restriction 310, such as, for example, the respective lengths and paths of inlet duct 106 and exhaust duct 114.

Motor controller 118 adjusts the variable speed of motor 116 by setting a motor speed set-point via a control signal. The control signal may include a pulse width modulated square wave having a duty cycle that represents the motor speed set-point. Motor controller 118 computes the motor speed set-point using a PI control loop. In alternative embodiments, motor controller 118 may utilize a proportional-integral-derivative (PID) control loop or any other suitable control scheme for computing the motor speed set-point. Within the PI control loop, the difference between the measured pressure differential across non-variable airflow restriction 310 and the pressure differential set-point is utilized as an error value upon which the proportional term and the integral term of the PI control loop operate. The output of the PI control loop is the motor speed set-point, i.e., the desired motor speed to turn blower 112 and to generate airflow 104. The PI control loop ensures the measured pressure differential converges on the pressure differential set-point and, more specifically, airflow 104 converges on the desired airflow 104 that is sufficient to achieve sufficient ventilation of combustion gasses through exhaust duct 114, high-efficiency combustion in gas burner 108, and high-efficiency heat transfer in heat exchanger 110.

Figure 4:
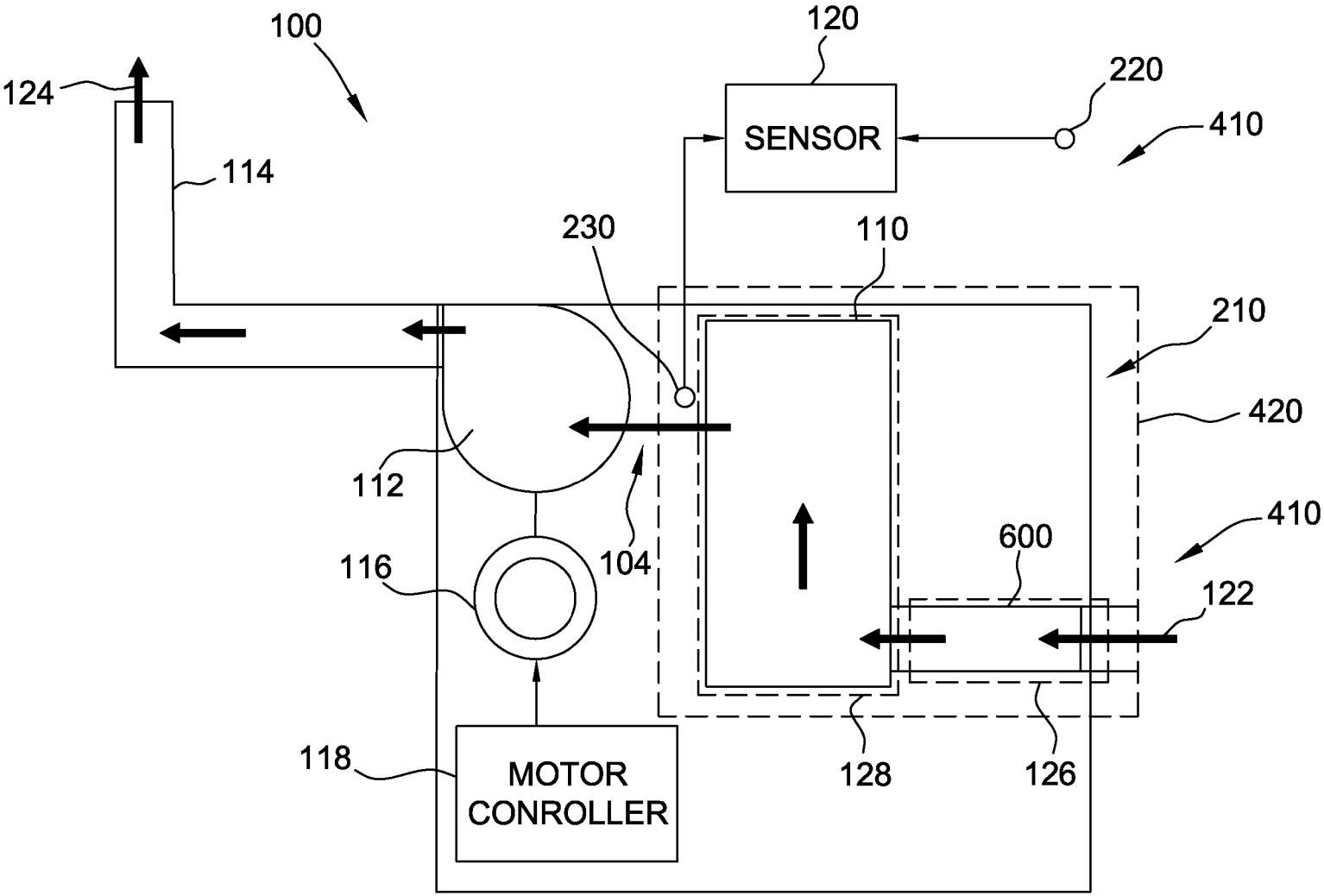
FIG. 4 is a schematic diagram of yet another embodiment of the gas-burning appliance shown in FIG. 1.

FIG. 4 is a schematic diagram of yet another embodiment of gas-burning appliance 100 (shown in FIG. 1). Gas-burning appliance 100 includes enclosure 210, gas burner 108, heat exchanger 110, blower 112, motor 116, and motor controller 118, and sensor 120.

Unlike the embodiments of FIGS. 2 and 3, the embodiment of FIG. 4 does not include inlet duct 106. Instead, inlet airflow 122 originates in an ambient airspace 410, and moves directly into gas burner 108. Airflow 104 is generated by the turning of blower 112 by motor 116 to draw-in inlet airflow 122. Without inlet duct 106, no airflow restriction is present before gas burner 108. Burner 108 carries out combustion of inlet airflow 122 and a fuel, producing combustion gasses that may include $NO_x$ gasses. Combustion gasses pass through heat exchanger 110, where heat is transferred from the combustion gasses to another medium, such as, for example, and without limitation, water. Airflow 104 carries the combustion gasses from heat exchanger 110, through blower 112, and through exhaust duct 114. Exhaust duct has a length and, in certain embodiments, one or more turns in its path. The length and turns of exhaust duct 114 at least partially define the airflow restriction it poses to airflow 104. Combustion gasses are vented from exhaust duct 114 as exhaust airflow 124. Furthermore, although blower 112 is shown as positioned proximate exhaust duct 114, it is contemplated that blower 112 may be located at any position along duct 102. For example, blower 112 may be located upstream of burner 108, either within or outside of enclosure 210, such that blower 112 pushes air through burner 108 rather than pulling air through burner 108, as is shown in FIG. 4.

Motor controller 118 controls motor 116, at least, by transmitting a control signal representing a variable motor speed. Motor controller 118 determines a motor speed set-point based on a pressure differential measured by sensor 120. Sensor 120 measures a pressure differential across heat exchanger 110 and gas burner 108, otherwise referred to as a non-variable airflow restriction 420. Non-variable airflow restriction 420 is composed of non-variable airflow restrictions 426 and 428, which respectively correspond to gas burner 108 and heat exchanger 110. The measured pressure differential across gas burner 108 and heat exchanger 110 generally does not change from installation to installation. Conversely, airflow 104 can change from installation to installation based on at least the length and path of exhaust duct 114. Changes in airflow 104 are reflected in the pressure differential measured by sensor 120, however, because sensor 120 measures the pressure differential across non-variable airflow restriction 420, any changes in measured pressure differential are attributed to variables external to non-variable airflow restriction 420, such as, for example, the length and path of exhaust duct 114.

In the embodiment of FIG. 4, sensor 120 measures a pressure differential across gas burner 108 and heat exchanger 110. Without inlet duct 106, inlet airflow 122 is drawn from ambient airspace 410. Accordingly, sensor 120 includes first node 220 disposed in ambient airspace 410. Sensor 120 includes second node 230 disposed at an inlet of blower 112, where airflow 104 moves from heat exchanger 110 into blower 112. Sensor 120 measures the pressure differential over time and transmits the measurements to motor controller 118. The frequency at which sensor 120 measures the pressure differential varies per embodiment and per installation. In certain embodiments, for example, and without limitation, sensor 120 measures the pressure differential five times per second, or at a frequency of 5 Hertz. In alternative embodiments, sensor 120 may be configured to operate at any suitable frequency for producing stable control of motor 116. Motor controller 118 computes a rolling average of the measured pressure differential and compares the average pressure differential to a pressure differential set-point. The pressure differential set-point is predetermined for gas burner 108 and heat exchanger 110 to represent a desired airflow 104 to achieve sufficient ventilation of combustion gasses through exhaust duct 114, high-efficiency combustion in gas burner 108, and high-efficiency heat transfer in heat exchanger 110. Motor controller 118 adjusts the variable speed of motor 116 to compensate for differences in the measured pressure differential relative to the pressure differential set-point, which, as described above, are attributed to variables external to gas burner 108 and heat exchanger 110, such as, for example, the length and path of exhaust duct 114.

Motor controller 118 adjusts the variable speed of motor 116 by setting a motor speed set-point via a control signal. The control signal may include a pulse width modulated square wave having a duty cycle that represents the motor speed set-point. Motor controller 118 computes the motor speed set-point using a PI control loop. In alternative embodiments, motor controller 118 may utilize a proportional-integral-derivative (PID) control loop or any other suitable control scheme for computing the motor speed set-point. Within the PI control loop, the difference between the measured pressure differential across non-variable airflow restriction 420 and the pressure differential set-point is utilized as an error value upon which the proportional term and the integral term of the PI control loop operate. The output of the PI control loop is the motor speed set-point, i.e., the desired motor speed to turn blower 112 and to generate airflow 104. The PI control loop ensures the measured pressure differential converges on the pressure differential set-point and, more specifically, airflow 104 converges on the desired airflow 104 that is sufficient to achieve sufficient ventilation of combustion gasses through exhaust duct 114, high-efficiency combustion in gas burner 108, and high-efficiency heat transfer in heat exchanger 110.

Figure 5:
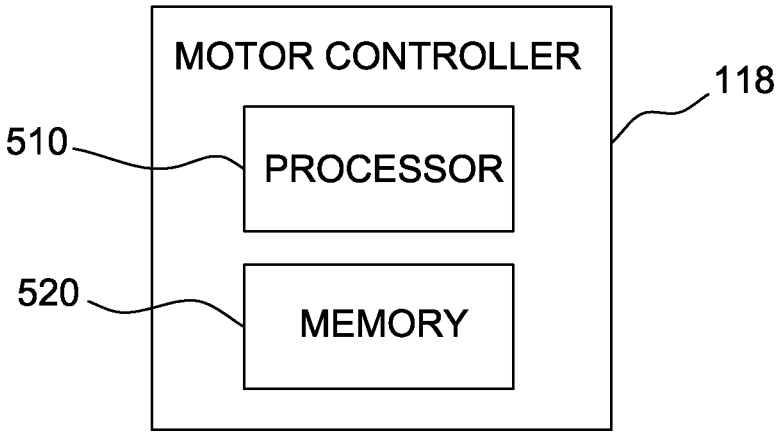
FIG. 5 is a block diagram of the motor controller shown in FIGS. 1-4.

FIG. 5 is a block diagram of motor controller 118 (shown in FIGS. 1-4). Motor controller 118 includes a processor 510 and a memory 520. Memory 520 is a non-transitory memory that stores computer-executable instructions and data for operating motor controller 118. In certain embodiments, memory 520 stores at least one pressure differential set-point for gas-burning appliance 100. For example, in one embodiment, memory 520 stores a plurality of pressure differential set-points respectively corresponding to the various non-variable airflow restrictions across which sensor 120 may measure a pressure differential. In such an embodiment, memory 520 may store a first pressure differential set-point for blower 112, a second pressure differential set-point for heat exchanger 110, and a third pressure differential set-point for gas burner 108. Memory 520 may further store additional pressure differential set-points for any other non-variable airflow restriction of gas-burning appliance 100, such as, for example, non-variable airflow restriction 310 (shown in FIG. 3). Memory 520 may further store additional pressure differential set-points representing combinations of any other non-variable airflow restrictions, such as, for example, non-variable airflow restriction 420. In such an embodiment, processor 510 is configured to utilize an appropriate pressure differential set-point for a given installation.

Processor 510 periodically receives pressure differential measurements from sensor 120 and gains access to the pressure differential set-point. Processor 510, in certain embodiments, is configured to implement a PI control loop for computing a motor speed set-point for motor 116. Processor 510 computes the motor speed set-point based on a difference between a time-average pressure differential and the pressure differential set-point. Processor 510 then generates a control signal for motor 116 and may further include a pulse width modulation component to adjust the duty cycle of the control signal to represent the motor speed set-point. Processor 510, in certain embodiments, updates the motor speed set-point for motor 116 on a periodic basis. For example, in one embodiment, processor 510 updates the motor speed set-point once every 10 seconds. In alternate embodiments, processor 510 is configured to update the motor speed set-point at any suitable frequency that produces stable control and convergence of the measured pressure differential to the pressure differential set-point.

Figure 6:
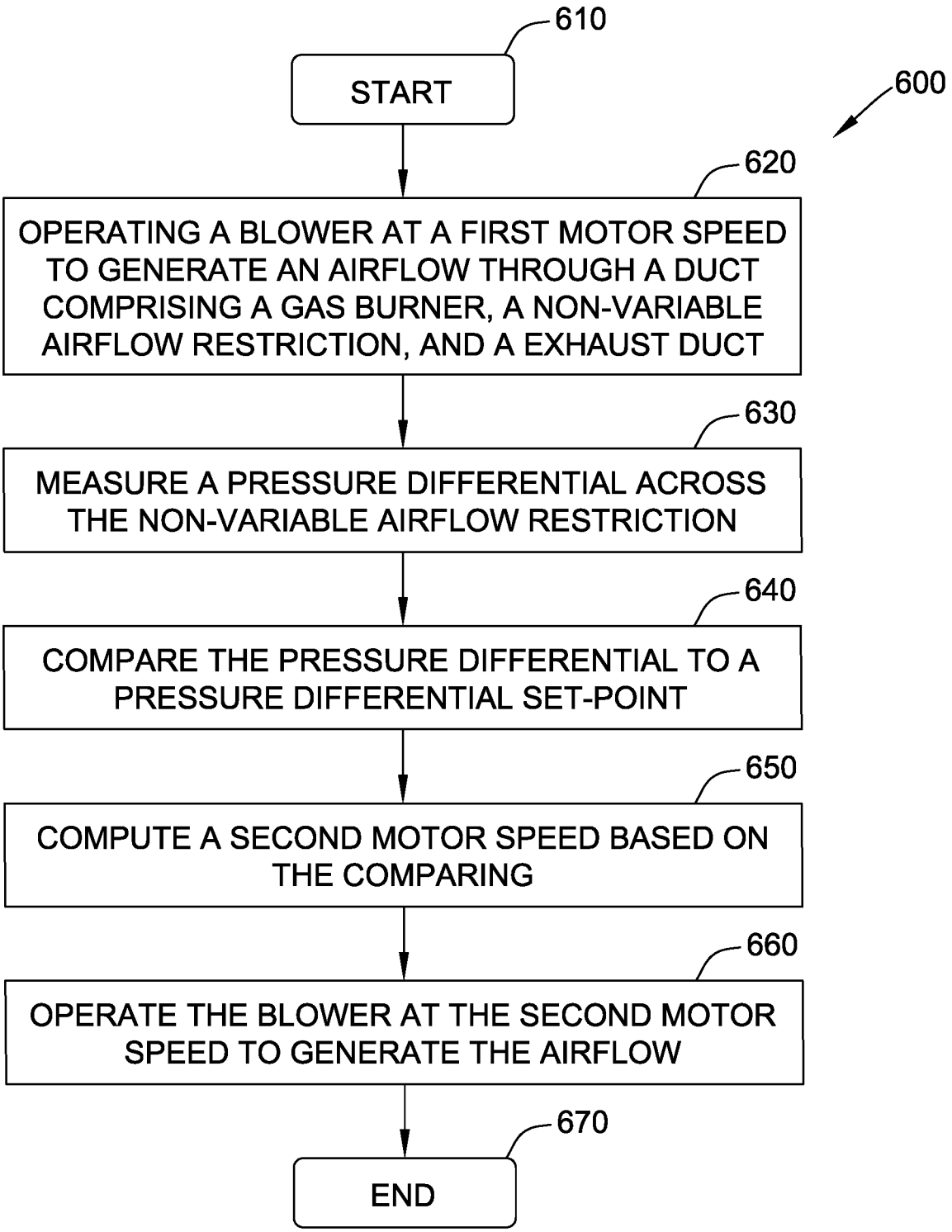
FIG. 6 is a flow diagram of an exemplary method of controlling a blower in the gas-burning appliance shown in FIGS. 1-4.

FIG. 6 is a flow diagram of an exemplary method 600 of controlling blower 112 in gas-burning appliance 100 (shown in FIGS. 1-4). Method 600 begins at a start step 610. At an operating step 620, motor controller 118 controls motor 116 to operate blower 112 at a first motor speed to generate airflow 104 through duct 102, which includes a non-variable airflow restriction, such as, for example, and without limitation, non-variable airflow restrictions 126, 128, 130, 310, or 420. A pressure differential is measured by sensor 120 across the non-variable airflow restriction at a measuring step 630. Motor controller 118 compares measured pressure differential to a pressure differential set-point at a comparing step 640. In certain embodiments, sensor 120 takes a plurality of pressure differential measurements and motor controller 118 computes a rolling average of the plurality of pressure differential measurements. In such embodiments, motor controller 118 compares the average pressure differential to the pressure differential set-point. At a computing step 650, motor controller 118 computes a second motor speed based on the result of comparing step 640. In certain embodiments, motor controller 118 uses a PI control loop to compute the second motor speed based on a difference between the average pressure differential and the pressure differential set-point. At an operating step 660, motor controller 118 controls motor 116 to operate blower 112 at the second motor speed to generate airflow 104. The method terminates at an end step 670.

Motor controllers described herein operate a blower to sufficiently exhaust combustion gasses and to achieve high-efficiency combustion and heat exchange. Embodiments of the motor controller described herein utilize pressure differential measurements across a non-variable airflow restriction within the gas-burning appliance to adjust a variable motor speed at which the blower is operated. Measured pressure differential is compared to a pressure differential set-point to adjust motor speed using a PI control loop. Motor controllers described herein achieve sufficient exhaust and high-efficiency combustion and heat exchange regardless of inlet duct length and further regardless of exhaust duct length.

The methods and systems described herein may be implemented using computer programming or engineering techniques including computer software, firmware, hardware or any combination or subset thereof, wherein the technical effect may include at least one of: (a) operating a blower for a gas-burning appliance at a variable speed; (b) controlling airflow through a gas-burning appliance based on measured pressure differentials; (c) ensuring proper ventilation of combustion gasses from the gas-burning appliance; (d) improving efficiency of combustion and heat transfer in the gas-burning appliance; (e) simplifying selection, installation, and configuration of gas-burning appliances by eliminating the duct-length variable; (f) simplifying selection, installation, and configuration of gas-burning appliances by eliminating considerations of line voltage fluctuations and altitude; and (g) achieving proper ventilation and high-efficiency regardless of duct lengths.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the terms processor, processing device, and controller.

In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

As used herein, the terms "software" and "firmware" are interchangeable, and include any computer program stored in memory for execution by a processor, including RAM memory, ROM memory, EPROM memory, EEPROM memory, and non-volatile RAM (NVRAM) memory. The above memory types are examples only, and are thus not limiting as to the types of memory usable for storage of a computer program.

The systems and methods described herein are not limited to the specific embodiments described herein, but rather, components of the systems and/or steps of the methods may be utilized independently and separately from other components and/or steps described herein.

This written description uses examples to provide details on the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A motor controller for a blower in a gas-burning appliance, said motor controller comprising:

a processor configured to:

receive a plurality of measured pressure differentials measured over a sampling duration and measured across said blower by a sensor disposed in an airflow generated by said blower, wherein the sensor includes a first node positioned between a heat exchanger and said blower and a second node positioned at an outlet of said blower;

compute a rolling average pressure differential from the plurality of measured pressure differentials;

compare the average pressure differential to a pressure differential set-point;

compute a motor speed at which to operate said blower to exhaust combustion gasses from said gas-burning appliance, the motor speed based on the comparison of the average pressure differential to the pressure differential set-point for said gas-burning appliance; and operate said blower at the motor speed to drive the measured pressure differential toward the pressure differential set-point, wherein the blower is configured to channel the airflow through an exhaust duct.

2. The motor controller of claim 1, wherein said processor is further configured to operate said blower at the motor speed to drive the airflow toward a desired airflow associated with the pressure differential set-point, the desired airflow configured to sufficiently exhaust combustion by-products and efficiently transfer heat to a medium.

3. The motor controller of claim 2 further comprising a non-transitory memory configured to store the pressure differential set-point.

4. The motor controller of claim 1, wherein said processor is further configured to compute the motor speed based on a difference between the average pressure differential and the pressure differential set-point.

5. The motor controller of claim 4, wherein said processor comprises a proportional-integral (PI) controller configured to compute the motor speed based on the difference between the average pressure differential and the pressure differential set-point.

6. An exhaust system for a gas-burning appliance, comprising:

a blower configured to generate an airflow through a duct comprising a gas burner, a non-variable airflow restriction, and an exhaust duct;

a motor coupled to said blower and configured to operate said blower at a variable motor speed;

a pressure sensor disposed in the airflow and configured to measure a plurality of pressure differentials across said blower by the airflow over a sampling duration, wherein said pressure sensor includes a first node positioned between said non-variable airflow restriction and said blower and a second node positioned at an outlet of said blower;

a motor controller coupled to said motor and said pressure sensor, said motor controller configured to:

compute a rolling average pressure differential from the plurality of measured pressure differentials;

compare the average pressure differential to a pressure differential set-point;

compute a motor speed at which to operate said blower to exhaust combustion gasses from said gas-burning appliance, the motor speed based on the comparison of the average pressure differential to the pressure differential set-point; and operate said blower at the motor speed to converge the average pressure differential onto the pressure differential set-point.

7. The exhaust system of claim 6, wherein said non-variable airflow restriction comprises a heat exchanger and said gas burner.

8. The exhaust system of claim 6, wherein said blower is further configured to generate the airflow through an inlet duct coupled to said gas burner.

9. The exhaust system of claim 6, wherein said blower is further configured to draw the airflow from ambient air.

10. A method of controlling a blower in a gas-burning appliance, said method comprising:

operating a blower at a first motor speed to generate an airflow through a duct comprising a gas burner, a non-variable airflow restriction, and an exhaust duct;

measuring a plurality of pressure differentials across the blower over a sampling duration, wherein the plurality of pressure differentials are measured by a pressure sensor having a first node positioned between a heat exchanger and the blower and a second node positioned at an outlet of the blower;

computing a rolling average pressure differential from the plurality of measured pressure differentials;

comparing the average pressure differential to a pressure differential set-point;

computing a second motor speed at which to operate the blower to exhaust combustion gasses from the gas-burning appliance, the motor speed based on the comparing; and operating the blower at the second motor speed to modify the airflow.

11. The method of claim 10, wherein measuring the plurality of pressure differentials across the blower over a sampling duration comprises collecting a plurality of pressure differential measurements per second.

12. The method of claim 11, wherein comparing the pressure differential to the pressure differential set-point comprises computing a difference between the average pressure differential and the pressure differential set-point.

13. The method of claim 12, wherein computing the second motor speed comprises:

computing a proportional term according to the difference;

computing an integral term according to the difference; and summing the proportional term and the integral term to generate the second motor speed.

14. The method of claim 10, wherein computing the second motor speed is carried out at a frequency of 0.1 Hertz.

15. The method of claim 10, wherein operating the blower at the first blower speed to generate the airflow through duct comprises:

drawing the airflow through an inlet duct;

moving the airflow through the gas burner to evacuate combustion gasses;

moving the airflow through a heat exchanger to heat a medium; and exhausting the airflow through the exhaust duct.

16. The method of claim 15, wherein the pressure differential set-point is associated with a desired airflow that is sufficient to evacuate the combustion gasses and optimizes heating of the medium via the heat exchanger.

* * * * *